US007281588B2

(12) United States Patent
Shampine et al.

(10) Patent No.: US 7,281,588 B2
(45) Date of Patent: Oct. 16, 2007

(54) TUBULAR INJECTOR APPARATUS AND METHOD OF USE

(75) Inventors: Rod W. Shampine, Houston, TX (US); Lawrence J. Leising, Missouri City, TX (US); Yarom Polsky, Pearland, TX (US); Hubertus V. Thomeer, Houston, TX (US); Sarmad Adnan, Sugar Land, TX (US)

(73) Assignee: Schlumberger Technology Corporation, Sugarland, TX (US)

( * ) Notice: Subject to any disclaimer, the term of this patent is extended or adjusted under 35 U.S.C. 154(b) by 287 days.

(21) Appl. No.: 11/014,598

(22) Filed: Dec. 16, 2004

(65) Prior Publication Data

US 2005/0133228 A1 Jun. 23, 2005

Related U.S. Application Data

(60) Provisional application No. 60/531,236, filed on Dec. 19, 2003.

(51) Int. Cl.
*E21B 19/22* (2006.01)
*E21B 23/00* (2006.01)

(52) U.S. Cl. ..... 166/382; 166/384; 166/77.2

(58) Field of Classification Search ..... None
See application file for complete search history.

(56) References Cited

U.S. PATENT DOCUMENTS

| | | | | |
|---|---|---|---|---|
| 1,586,923 | A | 6/1926 | Townsend | |
| 3,215,203 | A | 11/1965 | Sizer | 166/77 |
| 4,154,310 | A | 5/1979 | Konstantinovsky | 175/40 |
| 5,188,174 | A * | 2/1993 | Anderson, Jr. | 166/77.3 |
| 6,264,128 | B1 | 7/2001 | Shampine et al. | 242/397.3 |
| 6,273,188 | B1 | 8/2001 | McCafferty et al. | 166/77.2 |
| 6,412,560 | B1 | 7/2002 | Bernat | 166/301 |
| 6,530,432 | B2 * | 3/2003 | Gipson | 166/384 |
| 2001/0040031 | A1 | 11/2001 | Shaaban et al. | 166/77.3 |
| 2004/0020639 | A1 | 2/2004 | Saheta et al. | 166/77.2 |

FOREIGN PATENT DOCUMENTS

| | | |
|---|---|---|
| EP | 0395167 | 4/1995 |
| EP | 0486324 | 3/1996 |
| GB | 1265338 | 3/1972 |

* cited by examiner

*Primary Examiner*—Frank Tsay
(74) *Attorney, Agent, or Firm*—Rodney Warfford; David Cate; Robin Nava

(57) ABSTRACT

The invention generally relates to apparatus and methods for moving tubulars into and out of a well bore, and particularly, a tubular injector with two or more gripping members which bind the outer surface of the tubular, two or more actuators which cause the gripping members to bind or release the tubular, and at least one reciprocator for translating a gripping member to move the tubular, or for repositioning the gripping member. A method of translating a tubular is also provided which includes the steps of binding the outer surface of a tubular with at least one gripping members by engagement with an actuator, and translating a gripping member by reciprocator to move the tubular.

23 Claims, 6 Drawing Sheets

TUBULAR INJECTOR APPARATUS AND METHOD OF USE

This application claims benefit to U.S. provisional application Ser. No. 60/531,236, filed Dec. 19, 2003.

BACKGROUND OF THE INVENTION

The present invention relates generally to a method and apparatus for moving tubulars into and out of a well bore. More specifically, the present invention is a coiled tubing injector and methods of use thereof.

In the oil and gas industries is commonplace for coiled tubing to be used for well drilling or well bore operations, such as drilling wells, deploying reeled completions, logging high angle boreholes, positioning tools, instruments, motors and the like, and deploying treatment fluids. Coiled tubing is used as a continuous strand and is therefore easier and faster than conventional pipe in many applications, particularly in horizontal or multi-lateral wells. Most coiled tubing installed into well bores is steel and is injected into the well with a hydraulically activated injector head that has two opposed rolling surface areas that effectively push the tubing into the well from above the well head, using friction to ensure control and movement of the tubing into the well bore and thereby exerting compressive forces on the tubing. The coiled tubing is small diameter, usually about 1.5 cm to 9 cm tubing, which is sufficiently flexible for the tubing to be coiled onto a drum to form the tube reel. Coiled tubing is thus relatively easy to store and transport, and may be provided in long sections (typically 6,500 meters) such that the tubing may be deployed relatively quickly.

Typically, the coiled tubing is shipped, stored, and used on the same coiled tubing reel. Coiled tubing reels are deployed from trucks or trailers for land-based wells and from ships or platforms for offshore wells. When spooling or unspooling coiled tubing on a reel, the tubing is subjected to bending forces that can cause tubing fatigue, and this fatigue is a major factor in determining the useful life of a coiled tubing work string. Coiled tubing reels typically rely on hydraulic power to operate the reel drive, brake, and spooling guide systems. Most coiled tubing reels can be powered in "in-hole" [i.e. running-in-hole (RIH)] and "out-hole" [i.e. pulling-out-of-hole (POOH)] directions. The reel drive and its associated motor provide the reel back-tension, that is the tension in the coiled tubing between the reel and the injector that is used to spool and unspool the tubing on the reel, prevent tubing sagging between the reel and the injector while running coiled tubing into or out of the wellbore, and keep the wraps secure on the reel. When coiled tubing is moving out of the well, the reel is exerting force as the tubing is bent and then secured onto the reel. This force imparts both elastic and plastic deformation energy into the tubing as it is bent. Conversely, as the tubing is moved into the well, the elastic energy along with the energy imparted to keep the tubing wraps tightly secured must be dissipated. This energy is normally dissipated as heat in the hydraulic system, or may be dissipated in a separate braking system.

Conventional coiled tubing operation equipment typically includes coiled tubing spooled on a reel to be dispensed onto and off of the reel during an operation, an injector to run coiled tubing into and out of a well, a gooseneck affixed to the injector to guide the coiled tubing between the injector and the reel, a control cab with the necessary controls and gauges, and a power supply. Additional or auxiliary equipment also may be included. Coiled tubing equipment, such as described in U.S. Pat. No. 6,273,188 (McCafferty et al.), incorporated herein by reference, is widely known in the industry. The power source typically comprises a diesel motor that is used to operate one or more hydraulic pumps. The motor, pump(s) and other functions of the unit are controlled from the control cab. Between the injector head and the reel resides the tubing guide or gooseneck. The tubing extends from the reel to an injector. The injector moves the tubing into and out of the wellbore. Between the injector and the reel is a tubing guide or gooseneck. The gooseneck is typically attached or affixed to the injector and guides and supports the coiled tubing from the reel into the injector. Typically, the tubing guide is attached to the injector at the point where the tubing enters and serves to control the entry of the tubing into the injector. As the tubing wraps and unwraps on the reel, the point of contact with the stored tubing moves from one side of the reel to the other (side to side) and the gooseneck controls the bending radius of the tubing as it changes direction. The gooseneck typically has a flared end that accommodates this side to side movement. Goosenecks are widely known in the field, including those disclose in U.S. patent application 2004/0020639 (Saheta, et al.), incorporated herein by reference.

Conventional injector heads include a chain drive arrangement which acts as a tube conveyor. Two loops of chain are provided, the chains typically carrying semi-circular grooved blocks which grip the tube walls. The chains are mounted on sprockets driven by hydraulic motor(s), using fluid supplied from the power pack. Such coiled tubing units have been in use for many years, however the applicant has identified a number of problems associated with the existing apparatus. The force which must be applied to the tubing by the injector head is usually considerable, and requires that the tubing is clamped tightly between the blocks carried by the driven chains. These large forces may also result in permanent radial deformation of the tubing, a phenomenon known in the industry as "slip crushing." When slip crushing occurs in the injector, that section of tubing may shrink until it stops transferring axial load to the injector, which in turn may increase the tubing stresses in other parts of the gripping area potentially leading to complete loss of gripping. Slip crushing also renders the tubing unsafe for use and must be replaced at great expense.

Further, the apparatus operates in difficult conditions, and the injector head is continually exposed to a variety of fluids carrying various particulates that can wear parts of the apparatus, such that frequent maintenance is required. Also, a fundamental problem with conventional injectors is that many of the modes of injector failure cause the tubing to fall freely into the well, or conversely, be ejected by pressure forces. Such modes of failure include motor failure, brake failure, chain failure, cavitation, loss of hydraulic oil, shaft breakage, gripper loss, etc. Finally, the processes and apparatus are very expensive and unreliable because of the use of elaborate equipment and apparatus means.

As such, a need exists for methods and apparatus for moving, or injecting, coiled tubing into and out of a well bore using simple devices which better maintain tubing integrity, minimize loss of coiled tube control, and require less maintenance, the need is met at least in part by the following invention.

SUMMARY OF THE INVENTION

The invention generally relates to apparatus and methods for moving tubulars into and out of a well bore, and particularly, a tubular injector and methods of use thereof. The tubular injectors generally comprise two or more gripping members which bind the outer surface, circumference, of the tubular, two or more actuators which cause the gripping members to bind or release the tubular, and at least one reciprocator for translating a gripping member to move the tubular, or for repositioning the gripping member.

In one embodiment of the invention, a tubular injector comprises three gripping members each binding the outer surface of the tubular, actuators for enabling or disabling each gripping member, and a reciprocator for translating a gripping member to move the tubular or repositioning the gripping member. The gripping members are slip type members with grooves to enhance gripping, and the actuators engage and force the gripping members to bind with outer circumference of the tubular. The reciprocator is hydraulically driven.

In another embodiment of the invention, a tubular injector is provided which comprises at least one reciprocator for translating a gripping member to move the tubular or repositioning the gripping member, wherein the reciprocator comprises a housing, a hydraulic piston, a hydraulic cylinder encasing the hydraulic piston, and a chamber and conduit to deliver hydraulic pressure to the hydraulic cylinder connected to the hydraulic motor. The injector also includes slip type gripping members, wherein each member binds the outer surface of the tubular, and bowl shaped actuators for enabling or disabling the gripping members which are in contact with and driven by the hydraulic piston.

A method of translating a tubular is also provided which includes the steps of binding the outer surface of a tubular with at least one gripping members by engagement with an actuator, and translating a gripping member by reciprocator to move the tubular.

DETAILED DESCRIPTION OF THE EMBODIMENTS

The description and drawings are presented solely for the purpose of illustrating the embodiments of the invention and should not be construed as a limitation to the scope and applicability of the invention. While the embodiments of the present invention are described herein as comprising certain features and/or elements, it should be understood that embodiments could optionally comprise further features and/or elements. In addition, the embodiments may also comprise features and/or elements others than the ones cited. In the summary of the invention and this detailed description, each numerical value should be read once as modified by the term "about" (unless already expressly so modified), and then read again as not so modified unless otherwise indicated in context.

The embodiments according to the invention generally relate to a methods and apparatus for moving tubulars into and out of a well bore, and particularly, a tubular injector and methods of use thereof. According to the invention there is provided apparatus for conveying a tubular, the apparatus comprising two or more gripping members where each member binds the outer surface of the tubular, two or more actuators which cause the gripping members to bind or release the tubular, and at least one reciprocator for translating a gripping member to move the tubular, or for repositioning the gripping member. By "circumferentially binding" or "binding" the outer surface of the tubular it is generally meant that a gripping member surrounds the tubular and binds by making significant, substantial, or even contiguous contact with the tubular.

The tubular may be coiled tubing, other relatively thin walled tube useful in the oil and gas industries, jointed tubulars, and the like. Commonly coiled tubing to be used for well drilling or well bore operations, such as drilling wells, deploying reeled completions, logging high angle boreholes, positioning tools, instruments, motors and the like, and deploying treatment fluids. The tubular is typically steel tubing, but may be any useful material, such as aluminum, copper, plastic, rubber, and the like.

The use of gripping members that bind, or circumferentially bind, the outer surface, or circumference, of the tubular helps minimize the plastic deformation of the tubular when bound by the gripping members, which often occurs in conventional tubular injectors having opposing pairs of clamping blocks. Further, using gripping members that bind the tubular may provide tighter grip force. The ability to bind the tubing with a greater force helps overcome the low friction conditions typically encountered when using tubulars in well bores. Also, using the gripping members according to the invention minimizes loss of tubular control.

Figure 1:
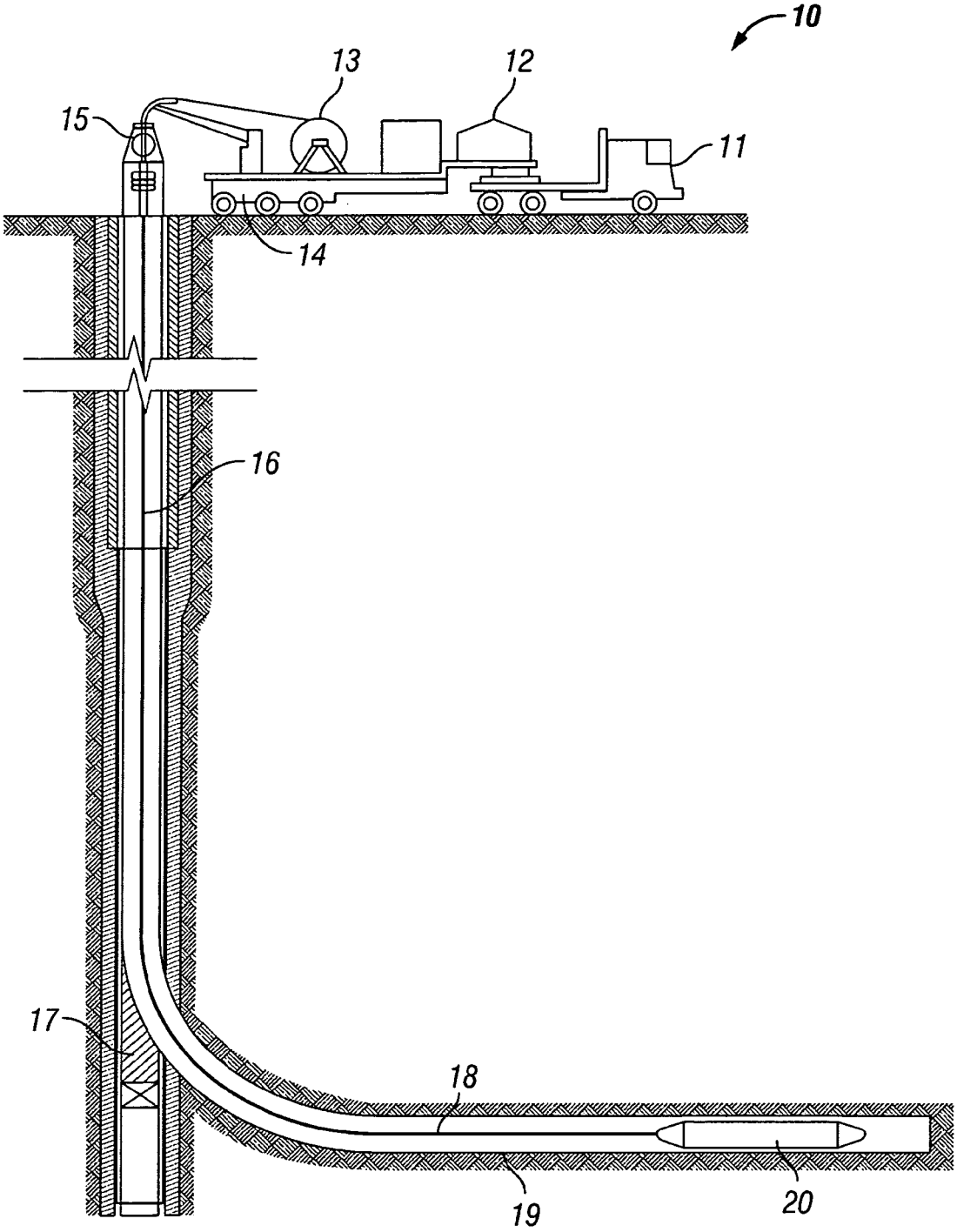
FIG. 1 shows the coiled tubing operating environment of this invention.

FIG. 1 shows a typical coiled tubing operating environment of the invention. In FIG. 1, a coiled tubing operation 10 comprises of a truck 11 and/or trailer 14 that supports power supply 12 and tubing reel 13. While an on-land operation is shown, the method or device according to the present invention is equally well suited for use in drilling for oil and gas as well and other coiled tubing operations both on land and offshore. Such trucks or trailers for coiled tubing operations are known. One such trailer is described in U.S. Pat. No. 6,237,188 (McCaferty et al.), incorporated herein in its entirety by reference. An injector head unit 15 feeds and directs coiled tubing 16 from the tubing reel into the subterranean formation. The configuration of FIG. 1 shows a horizontal wellbore configuration which supports a coiled tubing trajectory 18 into a horizontal wellbore 19. This invention is not limited to a horizontal wellbore configuration. Downhole tool 20 is connected to the coiled tubing, as for example, to conduct flow or measurements, or perhaps to provide diverting fluids.

Figure 2:
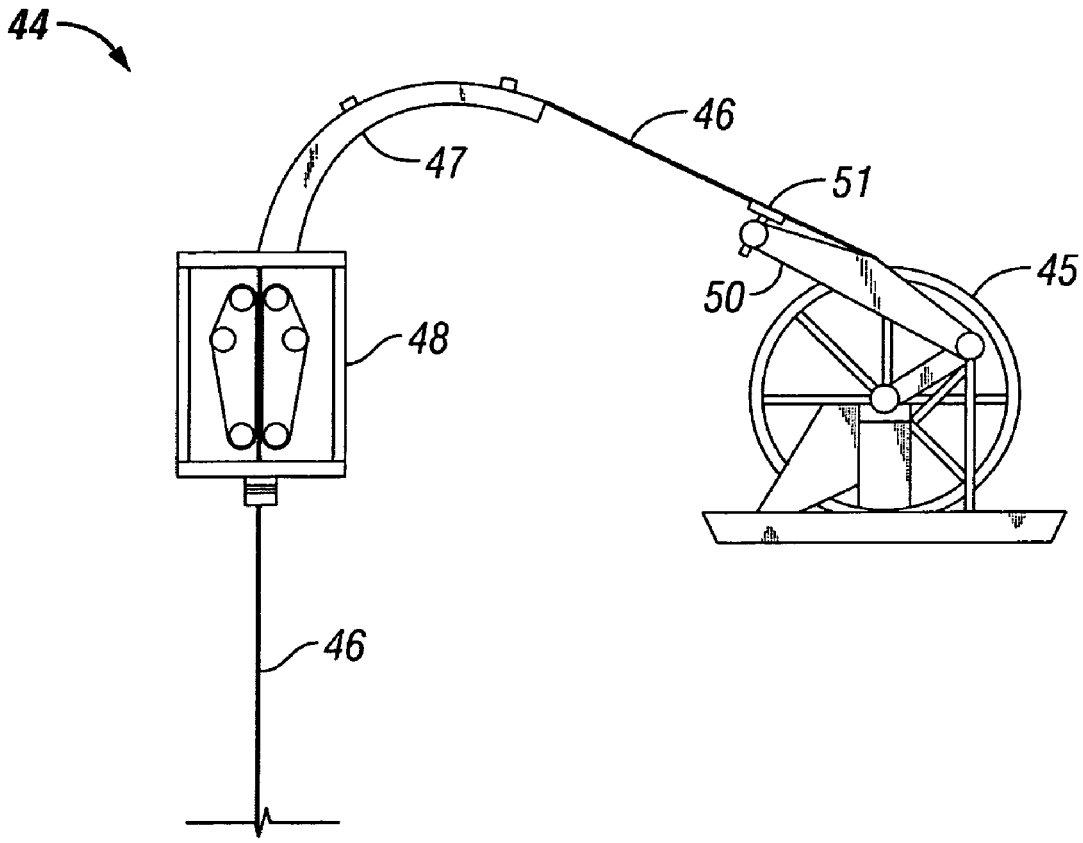
FIG. 2 represents a coiled tubing unit having a hydraulically operated tubing reel, gooseneck, and injector.

FIG. 2 represents a coiled tubing unit having a hydraulically operated tubing reel, gooseneck, and injector. The forces and strains placed upon coiled tubing when it is used in a coiled tubing unit 44 are apparent from viewing FIG. 2. Coiled tubing undergoes numerous bending events each time it is run into and out of a wellbore. The tubing is plastically deformed on the reel. Coiled tubing 46 is straightened when it emerges from the coiled tubing reel 45. Coiled tubing 46 is guided from the reel by way of levelwind assembly 50. Levelwind assemblies are known those skilled in the art. One such levelwind assembly is described in U.S. Pat. No. 6,264,128 (Shampine, et al.), incorporated herein in its entirety by reference. Coiled tubing brake 51 on the levelwind assembly 50 is shown. The coiled tubing is bent as it passes over the gooseneck 47, and is straightened as it goes into the injector head 48 for entry into the wellbore. Of course, each bending event is repeated in reverse when the tubing is later extracted from the wellbore.

According to the invention, any gripping member design may be used which is effective to bind the outer surface of the tubular. Examples of suitable designs include, but are not necessarily limited to, annular bag or metallic diaphragms, rubber elements compressed axially or radially using mechanical or hydraulic power, slip type grippers moving radially or on spiral paths, collet type grippers, and the like. Other examples of suitable designs which operate on the principle that load increases grip include, but are not necessarily limited to, wrapping springs or straps, basket weave grip (axial pull tightens grip), magnetostrictive, piezoelectric, shape memory alloy, and the like. Slip type grippers are preferred.

Figure 3:
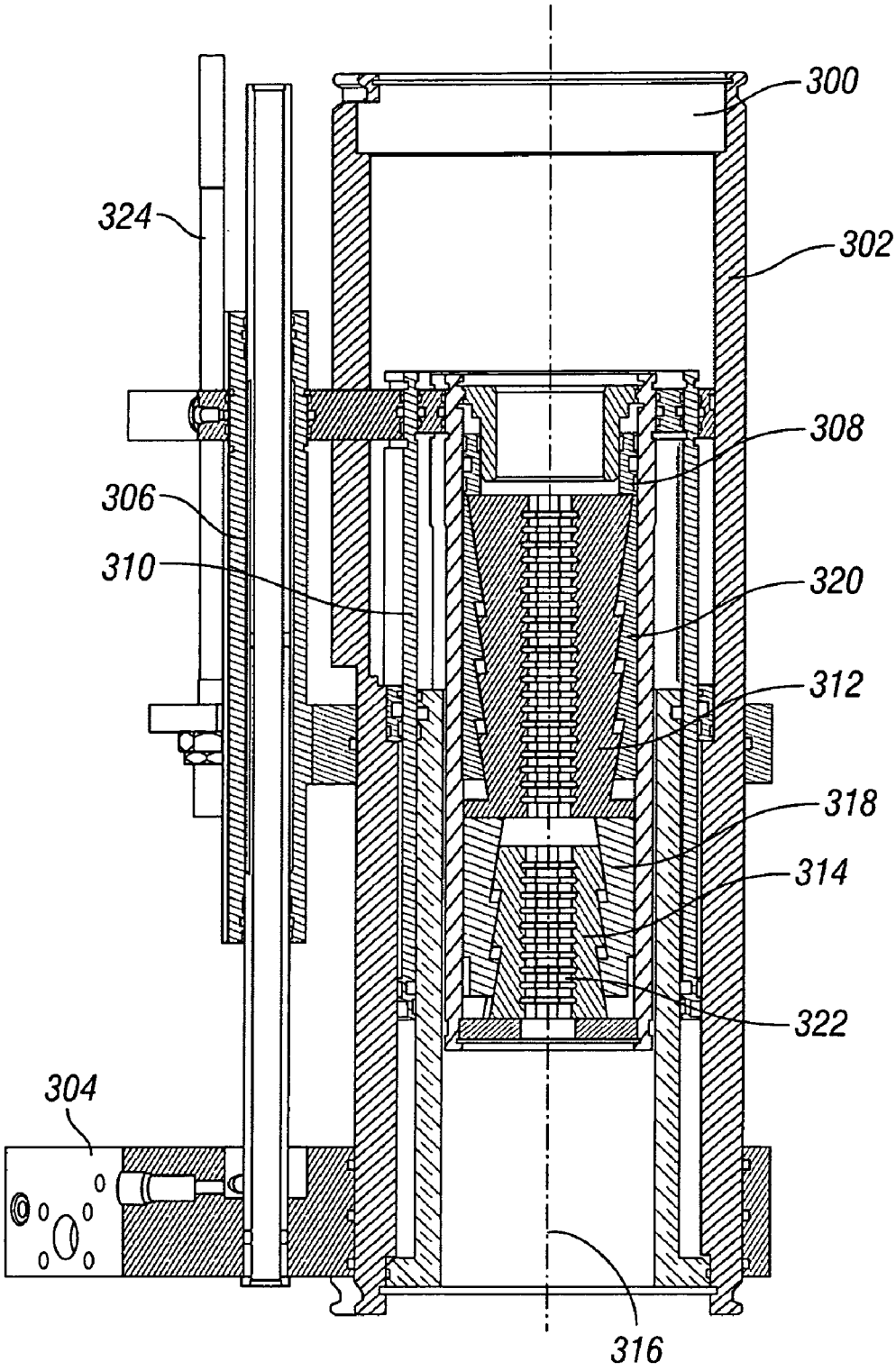
FIG. 3 illustrates in cross-section, a tubular injector according to the invention.

FIG. 3 illustrates in cross-section, a first embodiment of a tubular injector according to the invention. Injector 300 comprises a reciprocator. The reciprocator includes a housing 302 that is connected with a hydraulic manifold 304 and a chamber 306 to deliver hydraulic pressure to a hydraulic cylinder 308. Hydraulic pressure drives a hydraulic piston 310 which serves to translate a tubular parallel with centerline 316. Injector 300 also comprises slip type gripping members 312 and 314 for binding the outer surface of a tubular placed on centerline 316, and bowl shaped actuators 318 and 320 to enable or disable gripping members 312 and 314. Actuators 318 and slip type gripping member 312 are in contact with and driven by hydraulic piston 308. Gripping members 312 and 314 have grooves 322 (only one indicated) disposed about the tubular gripping surface to enhance circumferential tubular binding, which is particularly useful when the tubular has a coating of foreign material, such as oil, grease, grit, and the like. A position transducer 324 may be further used to indicate the position of the piston 308.

Figure 4:
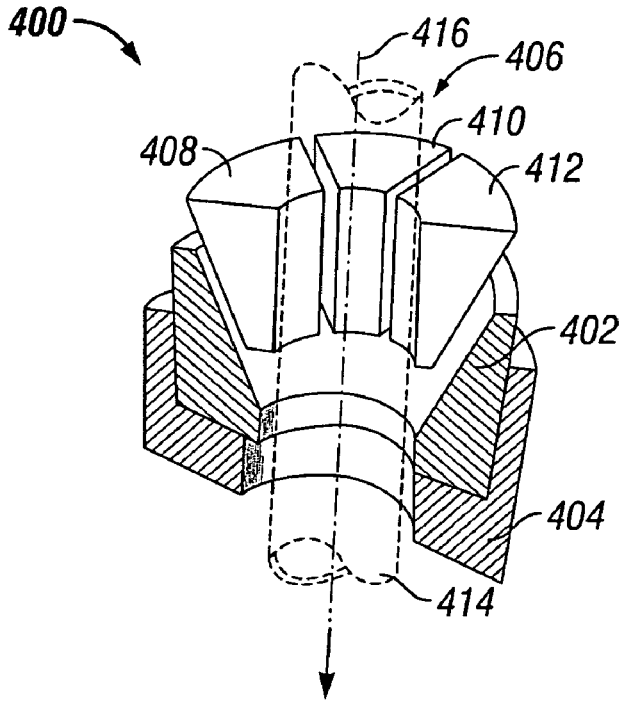
FIG. 4 is a three dimensional cross-section illustration of slip type gripping member used in a tubular injector according to the invention.

When slip type gripping members are used in injectors according to the invention, they are effective for reducing the slip-crushing load from that of a simple slip. Slip type members preferably comprise a bowl and moving slip assembly, wherein either may be fixed or movable. Referring now to FIG. 4, a three dimensional cross-section illustration of one embodiment of a slip type gripping member according to the invention, a slip type gripping member 400 comprises a fixed bowl 402 secured with the injector housing 404 and a moving slip assembly 406 comprising a plurality of slip sections, as illustrated by sections 408, 410, and 412. The moving slip assembly 406 is orientated in such way that moving the tubular 414 in a downhole direction axial to centerline 416 increases the gripping force of the gripping member 400. Downward axial forces act upon slip sections 408, 410, and 412 sliding the moving slip assembly 406 into bowl 402, producing a large radial force, which is dependent upon the angle of the bowl 402. Once the bowl 402 and moving slip assembly 406 are engaged, the downward axial force on the tubular 414 is translated into gripping force in direct proportion. For any tubular surface coefficient of friction, an appropriate bowl angle may be selected which optimally secures the tubular.

Figure 5:
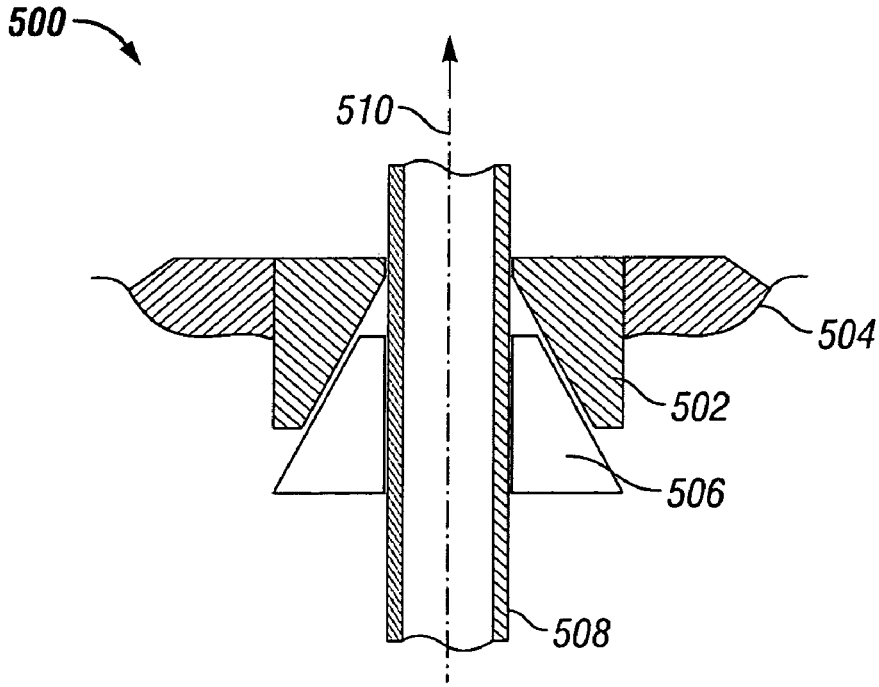
FIG. 5 is a cross-sectional illustration of a slip type gripping member useful in the invention.
Figure 6:
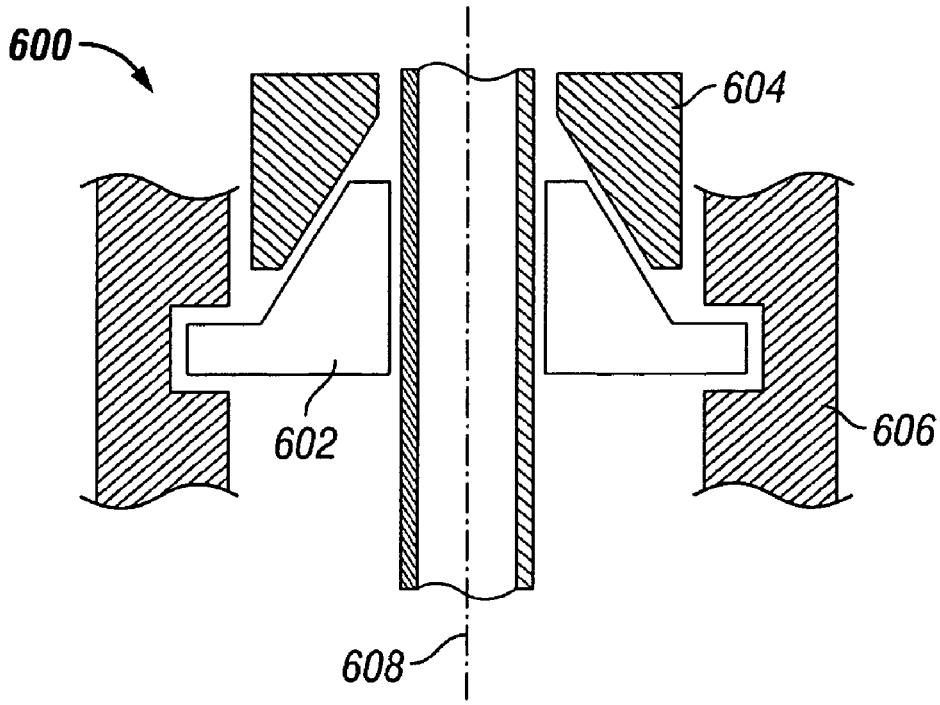
FIG. 6 is a cross-sectional illustration of a slip type gripping member useful in the invention.
Figure 7:
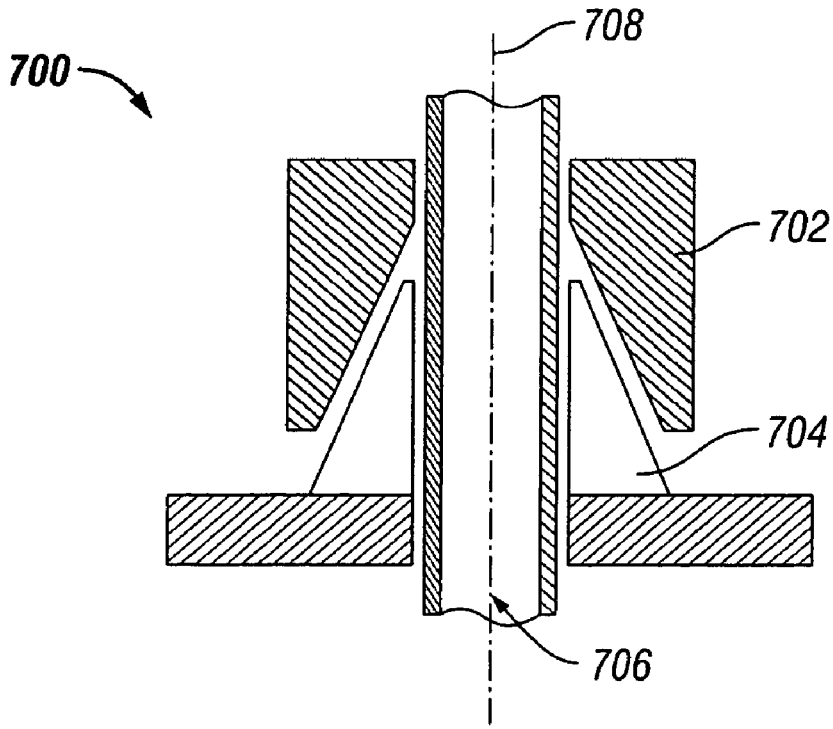
FIG. 7 is a cross-sectional illustration of a slip type gripping member useful in the invention.

Referring to FIG. 5, a cross-sectional illustration of a slip type gripping member according to the invention, a slip type gripping member 500 comprises a fixed bowl 502 secured with the injector housing 504 and a moving slip assembly 506. The fixed bowl 502 and a moving slip assembly 506 are oriented so that moving the tubular 508 in an upward direction from the well bore axial to centerline 510 (snubbing the tubular) increases the gripping force. Also, as illustrated in FIG. 6, cross-sectional illustration of another slip type gripping member 600, a fixed slip 602 and a moving bowl 604 may be orientated so that the tubular load force does not affect the gripping force. According to FIG. 6, in gripping member 600, the fixed slip 602 may be secured to the injector housing 606 in such way that the fixed slip 602 is fixed from moving in any axial direction parallel to centerline 608, but may move in a radial direction in a plane perpendicular to centerline 608. Further, as shown in FIG. 7, an illustration of yet another slip type gripping member 700, a moving bowl 702 and fixed slip 704 may be orientated in such way that moving the tubular 706 in a downhole direction axial to centerline 708 does not affect the gripping member 700 gripping force, but snubbing tightens the grip as the tubular 706 is moved upward. Furthermore, the bowl and slip may be orientated such that snubbing the tubular does not affect the gripping force but pulling tightens the grip.

Slip type gripping members used in injectors according to the invention may be combined in serial or parallel fashion. The gripping members may also be combined in such serial or parallel fashion where there are one or more devices applying gripping force and/or axial force. Also forces may be transferred through different gripping members to control how forces are distributed between a plurality of gripping members.

Hydraulically set and spring released or spring set and hydraulically released actuators are effective for enabling or disabling gripping members. Slip type gripping members may be designed so that the grip cannot be released while carrying tubing load. Also, as a safety measure, a slip gripping member may be designed, by adjusting the taper angle, such that it will slip-crush the tubular rather than release, and while any suitable angle may be used in this case, about a ten degree taper angle is preferred.

In an embodiment, the injector uses two gripping members, both of which can accommodate ±2 mm tubing diameter variation. The gripping members bind the tubular by enablement with an actuator and an annular piston capable of applying up to 17,700 kilograms of force. An upper gripping member is designed so that tubular pull tightens its grip and the taper angle is such that it cannot slip on oily tubulars. The additional gripping force provided by hydraulics allow it handle paraffin coated tubulars. A bottom gripping member is designed so that its gripping force does not change with tubular pull, but the gripping force includes both the hydraulic force and the axial pull force carried by the upper gripping member. This combination reduces slip-crushing stress in the tubular and allows the tubular to be pulled harder at a given coefficient of friction.

Figure 8:
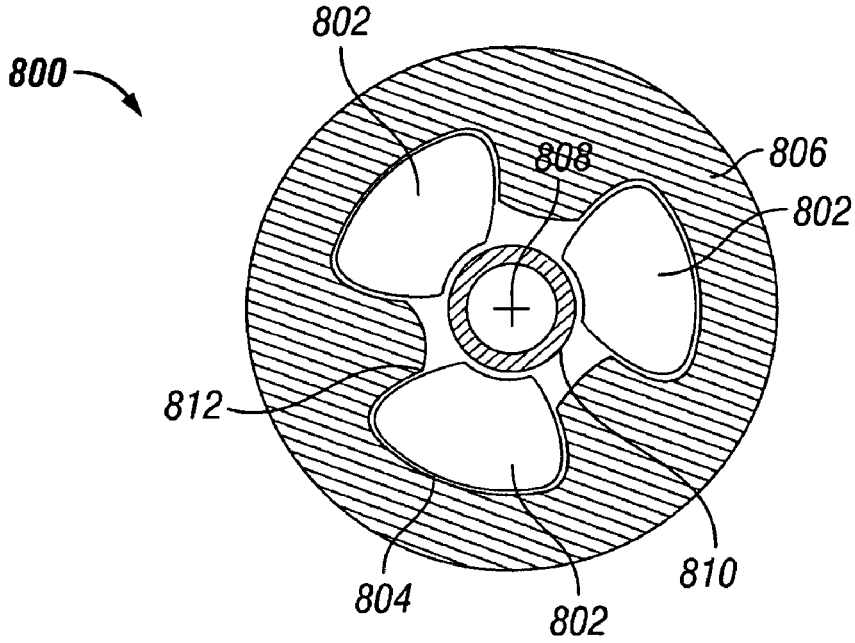
FIG. 8 is a cross-sectional top view showing tiltable gripping members comprising multiple sections.

Injectors of the invention may also use gripping members comprising a plurality of sections which may be arranged to carry similar loads yet accommodate varying tubular shapes or contact positions. This may be accomplished using tilting or hydrostatic mechanisms, including liquid and solid hydrostatic media such as rubber, polymers, and the like. Referring to FIG. 8, a cross-sectional top view showing gripping members comprising multiple tilting sections according to one embodiment of the invention, a gripping member 800 comprises slip sections 802 which have round outer surfaces 804 seated in a cylindrical groove of body 806. The grooves are formed angular with the center axis 808 upon which a tubular 810 is placed. Gripping force is placed upon or release from the tubular 810 as it is moved along axis 808 causing slip sections 802 to move both along axis 808 and in a plane perpendicular thereto. The slip sections 802 may also be free to pivot with the groove to equalize contact forces placed upon the contact surfaces 812 (only one indicated).

Figure 9:
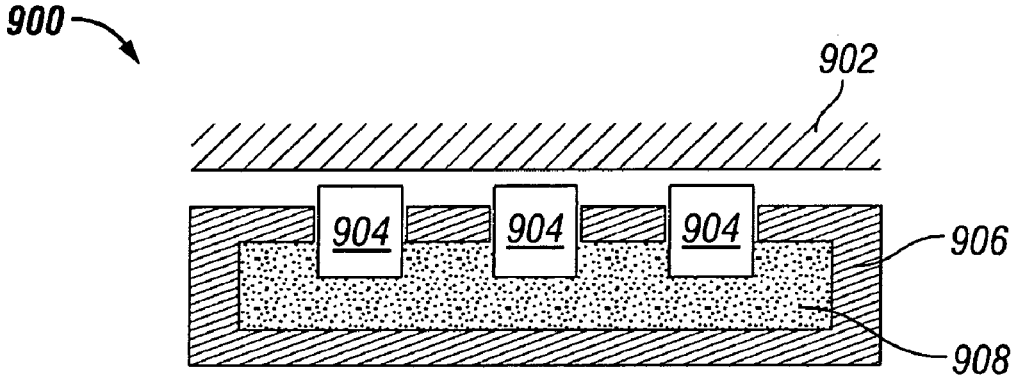
FIG. 9 is a cross-sectional side view showing a hydrostatic gripping member.

Now referring to FIG. 9, an embodiment of a gripping member 900 using a hydrostatic mechanism. The tubular 902 makes gripping contact with a plurality of gripping surfaces 904. The gripping surfaces 904 are impelled against the tubular 902 by action of hydrostatic material 908 that is contained by the housing 906. The gripping member 900 may be moved toward the tubular 902, for example, by a bowl and slip system. Any suitable hydrostatic material 908 may be used, including, by non-limiting example, liquids, as well solid hydrostatic media such as rubber, polymers, and the like.

The gripping members of the present invention may further comprise a wear indicating feature, such as by non-limiting example, a groove, a notch or stamp mark. Such a feature, when incorporated into the gripping member binding surface, may be used to indicate when it is worn to its service limit if the feature is flush with the gripping surface, or the feature is removed.

To further enhance any gripper member's gripping effectiveness the use of various mechanism or techniques may be used. Suitable examples include: electrical or magneto rheological fluids, recirculating fluid to remove any low coefficient materials from the tubular, and rubber excluder to remove oil and paraffin, or the grippers may even have magnetic or electromagnetic properties. Gripping binding surface may also incorporate one or more of the following features: grooved faces, circumferential, axial, and/or spiral; flat topped grooves with controlled radii transitioning from flat at the tubular contact to radial, where the bottom of the groove that does not contact the tubular may be any appropriate profile; grooves where the tubular is contacted by a controlled radius at the top of each groove; a pebbled surface such that the tubular is contacted by a large number of spherical sections, which is a cast surface or a surface produced by bonding spheres or hemispheres to the surface; a plastic or an elastomeric material containing element or elements trapped in a steel body such that they will not extrude excessively when they are forced against the tubular; high friction composite gripper surfaces comprised of high friction materials such as PEEK, urethane, brake pad material; a large number of radially oriented pieces of sheet metal, with narrow surfaces contacting the tubular pipe, which are joined by rubber or springs; or texture coatings.

For special and/or emergency applications, gripping members that have profiles, such as sharp edges, nibs, or teeth, arranged to protrude into the tubular a distance adequate to secure the tubular may be used in the injectors of the invention. The depth of protrusion may be controlled by any of the gripping mechanisms disclosed herein.

Embodiments of the invention also include at least one reciprocator for translating a gripping member to move the tubular in or out of the well bore, or for repositioning the gripping member. Any suitable technique or mechanism known in the art may be used as a reciprocator, including for example, but not limited to: hydraulic cylinders; magnetostrictive; piezoelectric; shape memory alloy; Poisson ratio cylinders (metal bar with hydraulic oil around it, lengthens when pressure is applied); annular cylinder/diaphragms; and annular pistons. When annual pistons are used with working fluid exposed to tubular, pressure differential sets the gripping system, pistons carry the tubular through a cylinder, and the mechanism is re-set. In a preferred embodiment, the reciprocator uses a hydraulic cylinder to translate a gripping member with the working fluid isolated from the tubular.

In another embodiment of a tubular injector according to the invention the injector is an "inchworm" like apparatus in operation. The injector comprises two or more slip gripping members which are capable of binding the outer surface of a tubular, actuators for enabling or disabling the gripping members which are hydraulically driven bowls that engage or disengage the slip gripping members, and at least one annular hydraulic cylinder driven reciprocator for translating a gripping member. Each gripping member and actuator forms a stroke unit, and may or may not include a reciprocator. The stroke units may be either in series (one connected to the next) or all the stroke units can be referenced to the frame of the injector. By non-limiting example, to move the tubular, a first gripping member is released from the tubular by disengagement from a corresponding first bowl actuator, and the member is moved relative to the tubular and then binds the tubular when the bowl actuator engages. Then a second gripping member, located above or below the first gripping member depending on the direction of travel, is released from the tubular by disengagement from a corresponding second bowl actuator, and the first bound gripping member moves the tubular. While the first gripping member moves the tubular, the second released gripping member is moved in an opposite direction to the tubular direction. The second gripping member then binds the tubular at the end of the first gripping member's movement stroke, and the process repeats. Each time this open gripper wave traverses the length of the injector, the tubing moves one stroke unit length. The speed of the tubing relative to this wave velocity is directly related to the number of open waves. The fastest motion is only one gripper gripping at any single time, and conversely, the slowest is only one gripper off at one time. The maximum binding force exerted will be related to the number of gripping members binding the tubing at one time.

In one injector embodiment based upon an inchworm design, three identical stroke units are stacked up, each with an approximately 30 cm stroke annular hydraulic cylinder moving a slip gripping member. Each hydraulic cylinder uses an accumulator to provide up to 11,500 kilograms of snubbing force per stroke unit and uses 34.5 MPa hydraulics to provide up to 23,000 kilograms of pull per section. When all three stroke units move together and then take turns going back to the initial position, the injector can pull 69,000 kilograms in non-continuous motion. When two stroke units are pulling together while the third unit is re-positioning to pull again, it will deliver 23,000 kilograms of pull at half of its maximum speed, but with continuous motion. Finally, with a single section pulling and the other two re-setting, it will deliver 23,000 kilograms of pull at full speed. Snubbing operations are similar, but with 34,500 kilograms, 23,000 kilograms, and 11,500 kilograms capacity. The injector can be readily scaled up or down by using two, four, or more stroke units. The only limit on the pull that can be achieved (other than the pipe) is that the housing of the bottom two stroke units must be able to carry the full load. The sections higher up in the injector typically require progressively less capacity.

Gripping members according to the invention may be translated using a hydraulic cylinder. This may be accomplished using hydraulic cylinders with four-port/three-way control valves where both sides of the cylinder are directly driven. Also, hydraulic cylinders with three-port/three-position valves may be used with an accumulator on one side to provide the return stroke. This latter design provides better volumetric and power efficiency, but may result in more complexity to control the force in one direction. The former design allows bidirectional power flow, using the injector as a pump, at the cost of complexity. Bidirectional power flow is fail-safe, and in the event of cavitation, the tubular may only drop one stroke unit, as compared with a conventional injector, in which the tubular may fall freely. Further, valve arrangement allowing regenerative action that may be switched off offers further improvement for high-speed operation.

As an non-limiting example of the fluid dynamics for hydraulic cylinders used according to the invention, if an injector consumes 2 liters per 30 cm of travel at 34.5 MPa, a double acting injector (with a 2:1 ratio between pull and snubbing force) will consume 3 liters per 30 cm at the same pressure. The extra 1 liter is oil used to re-set the injector piston. A single acting injector (with an accumulator on the snubbing side) will consume 2 liters per 30 cm of travel at 34.5 MPa as well. If it is required to be able to snub at full force, then it will need 34.5 Mpa of pressure. However, if the snubbing force is very low, the drive pressure can go as low as 23 Mpa. The double acting injector with a single supply is no better than 66% efficient. The single acting injector is between 66% and 100% efficient, decreasing with snubbing force. For 69,000 kilograms of force injector design, either the hydraulic system must be able to sustain (but not move during) a pressure 50% higher than normal operations or the snubbing pressure accumulator must be bled down so that the net force available from each gripper at rated force is 34,500 kilograms.

In an embodiment of the invention the injector's valve systems may be capable of supplying oil for translating tubulars up to about 45 meters per minute. To accomplish this, direct feedback control of the valves may be used, or even applying voltages higher than the continuous rating during the shifting time and then dropping back to the rated voltage during the holding period. Speed control of the injector and the sections may be accomplished by either having each section speed controlled directly, or a master flow control valve may be used with switching valves for each section. Even in the latter case some flow modulation may be required in order to get the proper transition profiles for smooth operation.

In another embodiment of the invention, the gripper member design has angled rollers or annular rings. A first such member binds the tubular surface and will make the tubing/roller system act like the tubing is threaded; if the set of rollers or rings is rotated around the tubular centerline, the tubing will translate in a direction parallel to tubular centerline. The angle of the rollers determines the longitudinal movement of tubular per rotation. A gripping member design of this type can handle a wide range of diameters.

In yet another embodiment of the invention, the gripper member design has a set of long rollers supported on their ends. When the end supports are rotated in opposite directions, the rollers come together, gripping the tubular. When the end supports are moved in the same direction, the rollers translate the tubular parallel to the centerline of the tubular. In this system, large diameter tubulars move a shorter distance per rotation than small diameter tubular, which is generally desired.

Injectors according the invention are scalable. By scalable it is meant the two, three, four, or more stroke units comprising gripping members, actuators, and reciprocators may be combined to provide a corresponding number of tubular pull lengths. Injectors of the invention may also be used as intermittent pull boosters for conventional injectors, or to vibrate the tubing to improve reach in horizontal wells, or even vibrate to release stuck tubing.

The injectors of the invention are capable of continuing to control and translate a tubular in scenarios wherein one or more stroke units may fail. The injector may operate with two stroke units only, or even in steps with a single stroke unit and a functional mechanism to secure the tubular load.

In one embodiment of the invention, an injector as designed it is capable of a 69,000 kilogram load pull in a 30 cm stroke distance in low speed gear, a 46,000 kilogram load pull in a middle speed gear, and a 23,000 kilogram load pull in a high speed gear. The injector also has 34,500 kilogram snubbing capacity in a low speed gear, a 23,000 kilogram snubbing capacity in a medium speed gear, and a 11,500 kilogram snubbing capacity in a high speed gear.

The particular embodiments disclosed above are illustrative only, as the invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular embodiments disclosed above may be altered or modified and all such variations are considered within the scope and spirit of the invention. Accordingly, the protection sought herein is as set forth in the claims below.

What is claimed is:

1. A tubular injector comprising:

a. a plurality of gripping members, wherein each member binds the outer surface of the tubular;

b. a plurality of actuators for enabling or disabling the gripping members; and, c. at least one reciprocator for translating a gripping member to move the tubular or for repositioning the gripping member, wherein the gripping members are collet shaped, and the actuators engage and force the gripping members to bind with outer surface of the tubular.

2. The tubular injector of claim 1 comprising at least three gripping members.

3. The tubular injector of claim 1 wherein each gripping member circumferentially binds the outer surface of the tubular.

4. The tubular injector of claim 2 comprising one stationary gripping member and at least two translatable gripping members.

5. The tubular injector of claim 1 wherein the gripping members are slip type gripping members, and the actuators engage and force the gripping members to bind with outer surface of the tubular.

6. The tubular injector of claim 1, wherein the at least one reciprocator is hydraulically driven.

7. A tubular injector comprising:

a. a plurality of gripping members, wherein each member binds the outer surface of the tubular;

b. a plurality of actuators for enabling or disabling the gripping members; and, c. at least one reciprocator for translating a gripping member to move the tubular or for repositioning the gripping member, wherein the at least one reciprocator is hydraulically driven. wherein the reciprocator is hydraulically driven.

8. The tubular injector of claim 1 wherein the tubular is coiled tubing.

9. The tubular injector of claim 1 wherein the gripping members further comprise a mechanism for enhancing the binding of the tubular.

10. The tubular injector of claim 9 wherein the gripping members further comprise grooves for enhancing the binding of the tubular.

11. The tubular injector of claim 9 wherein the gripping members further comprises a pebbled surface for enhancing the binding of the tubular.

12. The tubular injector of claim 9 wherein the gripping members further comprises a plastic or elastomeric material for enhancing the binding of the tubular.

13. The tubular injector of claim 9 wherein the gripping members further comprises a high friction material for enhancing the binding of the tubular.

14. The tubular injector of claim 1 wherein the gripping members further comprises a wear indicating feature.

15. A tubular injector comprising:

a. at least one reciprocator for translating a gripping member to move the tubular or repositioning the gripping member, wherein the reciprocator comprises a cylindrical housing, a hydraulic piston, a hydraulic cylinder encasing the hydraulic piston, and a chamber and conduit to deliver hydraulic pressure to the hydraulic cylinder;

b. a plurality of slip type gripping members, wherein each member binds the outer surface of the tubular; and c. a plurality of bowl shaped actuators for enabling or disabling the gripping members in contact with and driven by the hydraulic piston.

16. The tubular injector of claim 15 wherein the gripping members further comprise grooves for enhancing the binding of the tubular.

17. The tubular injector of claim 15 wherein the gripping members further comprises a wear indicating feature.

18. The tubular injector of claim 15 wherein each gripping member circumferentially binds the outer surface of the tubular.

19. A method of translating a tubular comprising the steps of binding the outer surface of a tubular with at least one gripping member by engagement with an actuator, and translating a gripping member by a reciprocator to move the tubular, wherein the at least one gripping member is collet shaped.

20. The method of claim 19 wherein the tubular is coiled tubing.

21. The method of claim 19 used for oil well operations.

22. The method of claim 19 used for gas well operations.

23. A method of translating a tubular comprising the steps of binding the outer surface of a tubular with at least one gripping member by engagement with an actuator, and translating a gripping member by a hydraulically driven reciprocator to move the tubular.

* * * * *